US006686889B1

(12) United States Patent
Kwon et al.

(10) Patent No.: US 6,686,889 B1
(45) Date of Patent: Feb. 3, 2004

(54) METHOD AND APPARATUS FOR ANTENNA ORIENTATION AND ANTENNA WITH THE SAME

(75) Inventors: Tae In Kwon, Incheon (KR); Soo Jung Pak, Seoul (KR); Woong Seob Jeong, Incheon (KR)

(73) Assignee: Tae I. Kwon, Incheon (KR)

( * ) Notice: Subject to any disclaimer, the term of this patent is extended or adjusted under 35 U.S.C. 154(b) by 0 days.

(21) Appl. No.: 09/857,254

(22) PCT Filed: Jun. 12, 1999

(86) PCT No.: PCT/KR99/00741

§ 371 (c)(1),
(2), (4) Date: May 31, 2001

(87) PCT Pub. No.: WO00/35049

PCT Pub. Date: Jun. 15, 2000

(30) Foreign Application Priority Data

| | | |
|---|---|---|
| Dec. 8, 1998 | (KR) | 98-53530 |
| Jan. 11, 1999 | (KR) | 99-00451 |
| Mar. 5, 1999 | (KR) | 99-07383 |
| Mar. 5, 1999 | (KR) | 99-07384 |
| Mar. 5, 1999 | (KR) | 99-07385 |
| Mar. 17, 1999 | (KR) | 99-08965 |
| Mar. 22, 1999 | (KR) | 99-09751 |
| Apr. 7, 1999 | (KR) | 99-12108 |
| Apr. 7, 1999 | (KR) | 99-12109 |
| Apr. 24, 1999 | (KR) | 99-14781 |
| Jun. 23, 1999 | (KR) | 99-23860 |
| Jun. 23, 1999 | (KR) | 99-23861 |
| Jul. 2, 1999 | (KR) | 99-12938 |
| Oct. 16, 1999 | (KR) | 99-44957 |

(51) Int. Cl.[7] ..... H01Q 3/02
(52) U.S. Cl. ..... 343/760; 343/894; 342/359
(58) Field of Search ..... 343/840, 761, 343/894, 757, 882, 760; 342/359

(56) References Cited

U.S. PATENT DOCUMENTS

| | | | | |
|---|---|---|---|---|
| 5,760,739 A | | 6/1998 | Pauli | 342/359 |
| 5,870,059 A | * | 2/1999 | Reynolds | 343/894 |

FOREIGN PATENT DOCUMENTS

| | | | |
|---|---|---|---|
| JP | 57207267 | 11/1982 | H01Q/19/02 |
| JP | 61125340 | 5/1986 | H01Q/19/19 |
| JP | 07177817 | 7/1995 | H01Q/3/08 |

* cited by examiner

*Primary Examiner*—Michael C. Wimer
(74) *Attorney, Agent, or Firm*—Lee, Hong, Degerman, Kang & Schmadeka

(57) ABSTRACT

An apparatus and a method for orienting an antenna to a transmitter, and an antenna using the apparatus are disclosed. The apparatus for orienting an antenna toward a transmitter, which is used with an antenna, comprises a shadow generating means fixedly mounted to the antenna so as to generate a shadow of the sun, and target indicating means for specifying a target point on a reflector, at which a predetermined portion of the shadow generated by the shadow generating means should be positioned when the antenna is correctly oriented toward the transmitter. The method for orienting an antenna toward a transmitter using the above-menitionied apparatus comprises the steps of mounting a shadow generating means to the antenna, determining the target point on the basis of the type of a satellite, location information of the antenna and time information of the antenna orienting operation, and adjusting a direction of the antenna so that the predetermined portion of the shadow generated by the shadow generating means coincides with the target point. In addition, the antenna including the above-described antenna orienting apparatus is also provided.

20 Claims, 13 Drawing Sheets

【Fig. 1】
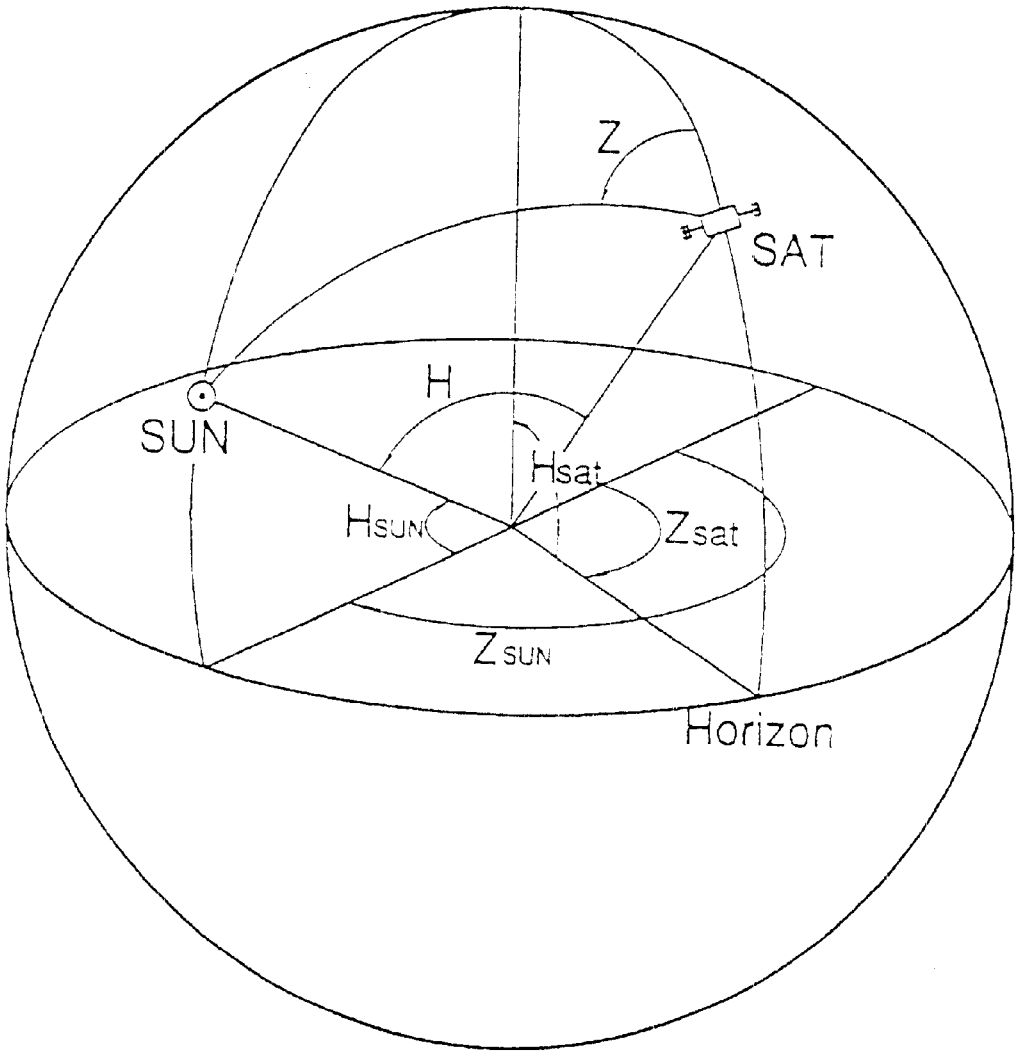

【Fig. 2】
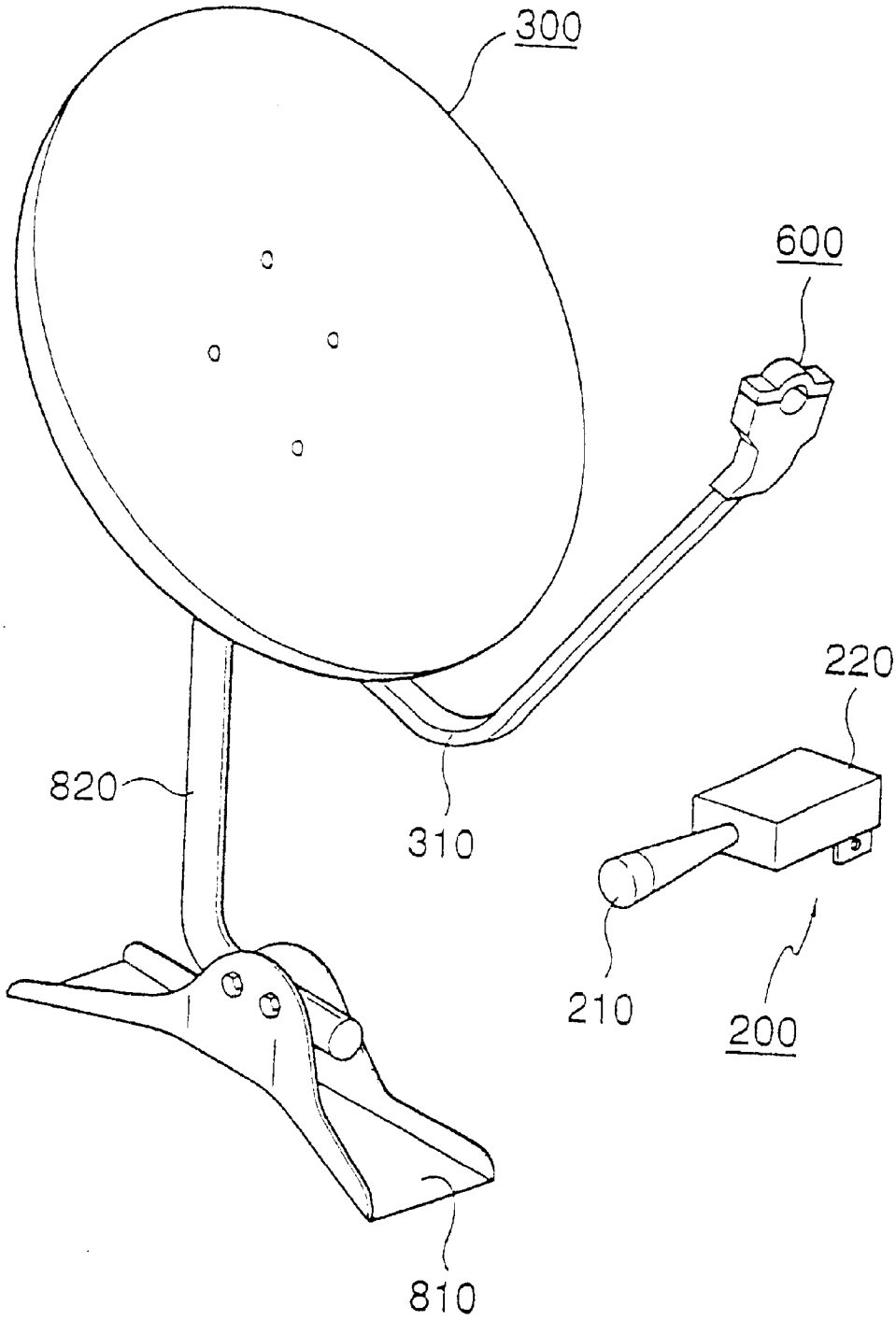

【Fig. 3a】
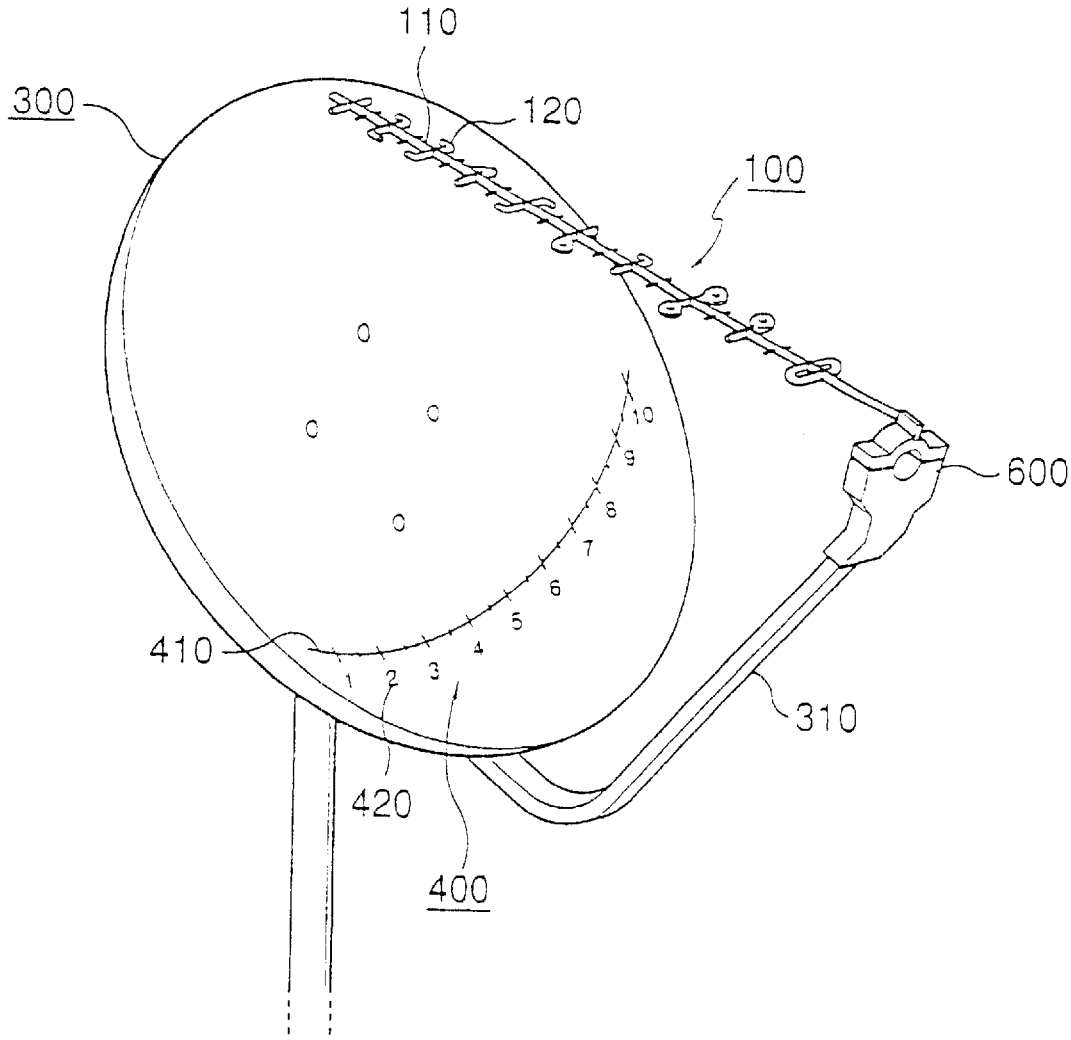

【Fig. 3b】
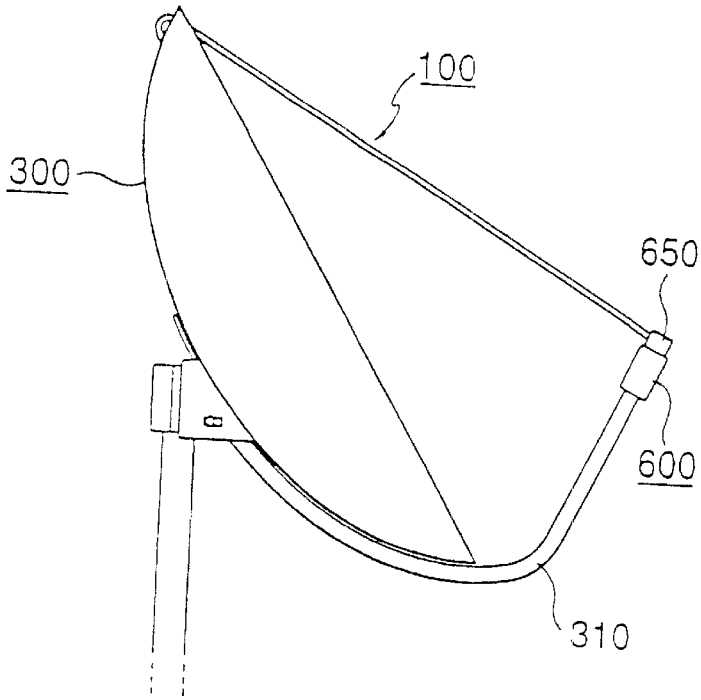
【Fig. 3c】
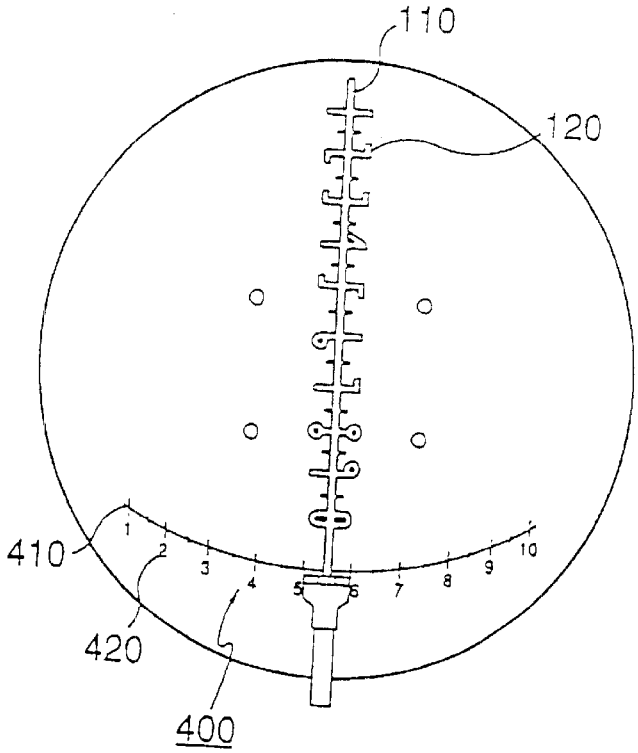

【Fig. 4a】
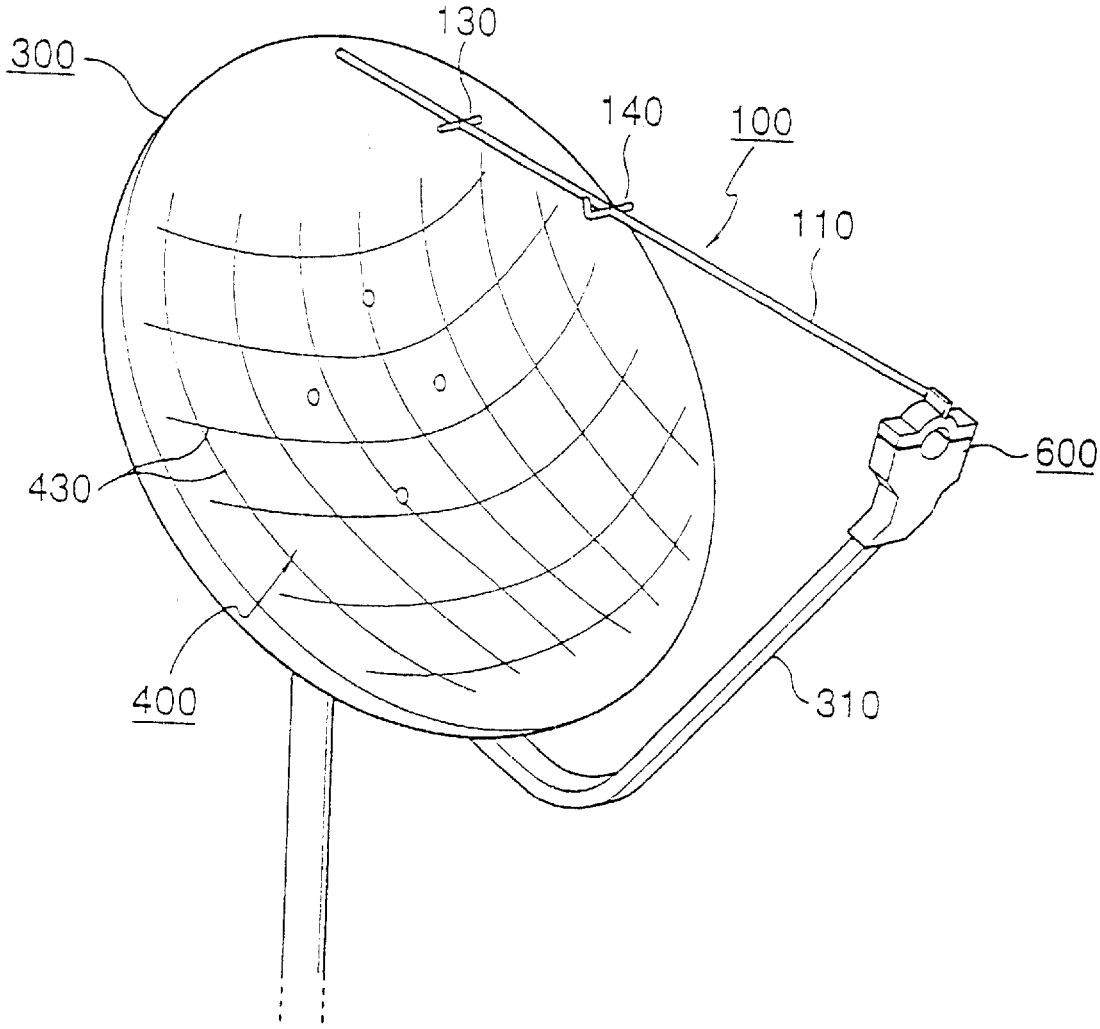

【Fig. 4b】
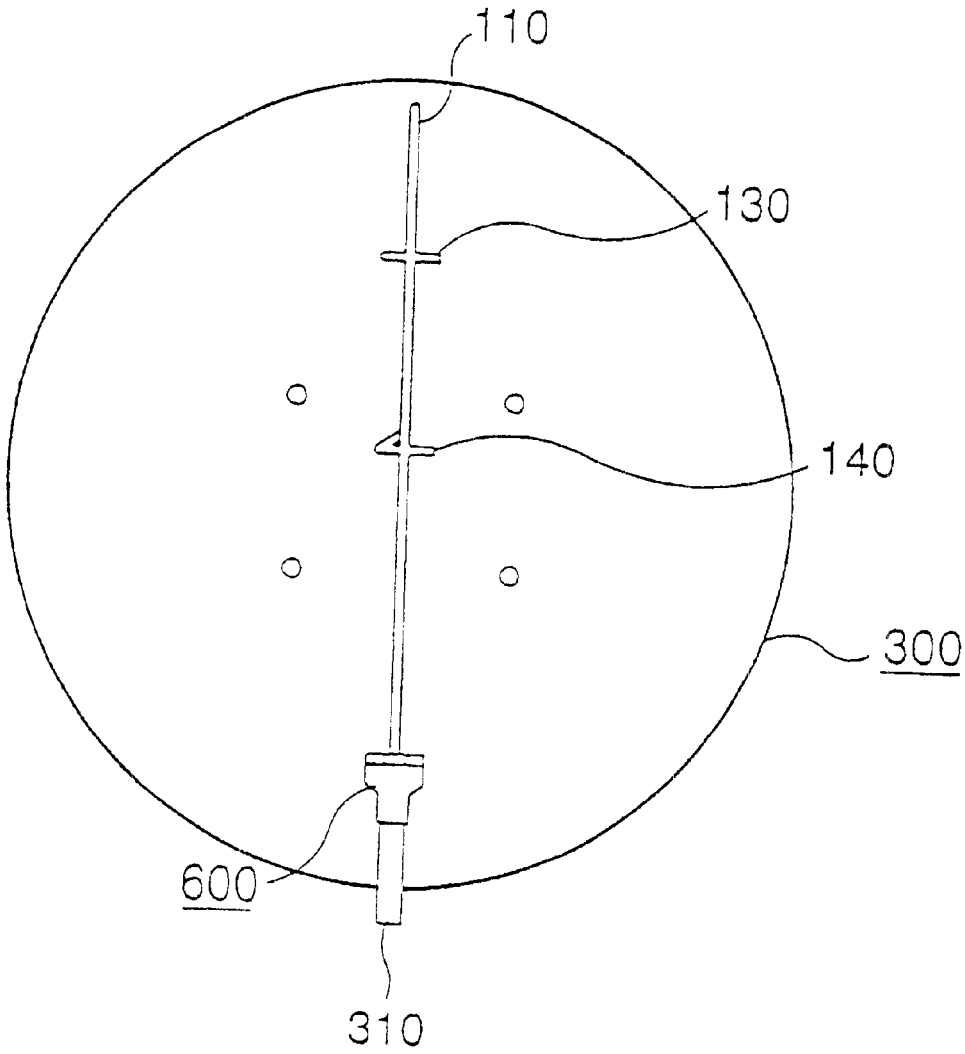

【Fig. 4c】
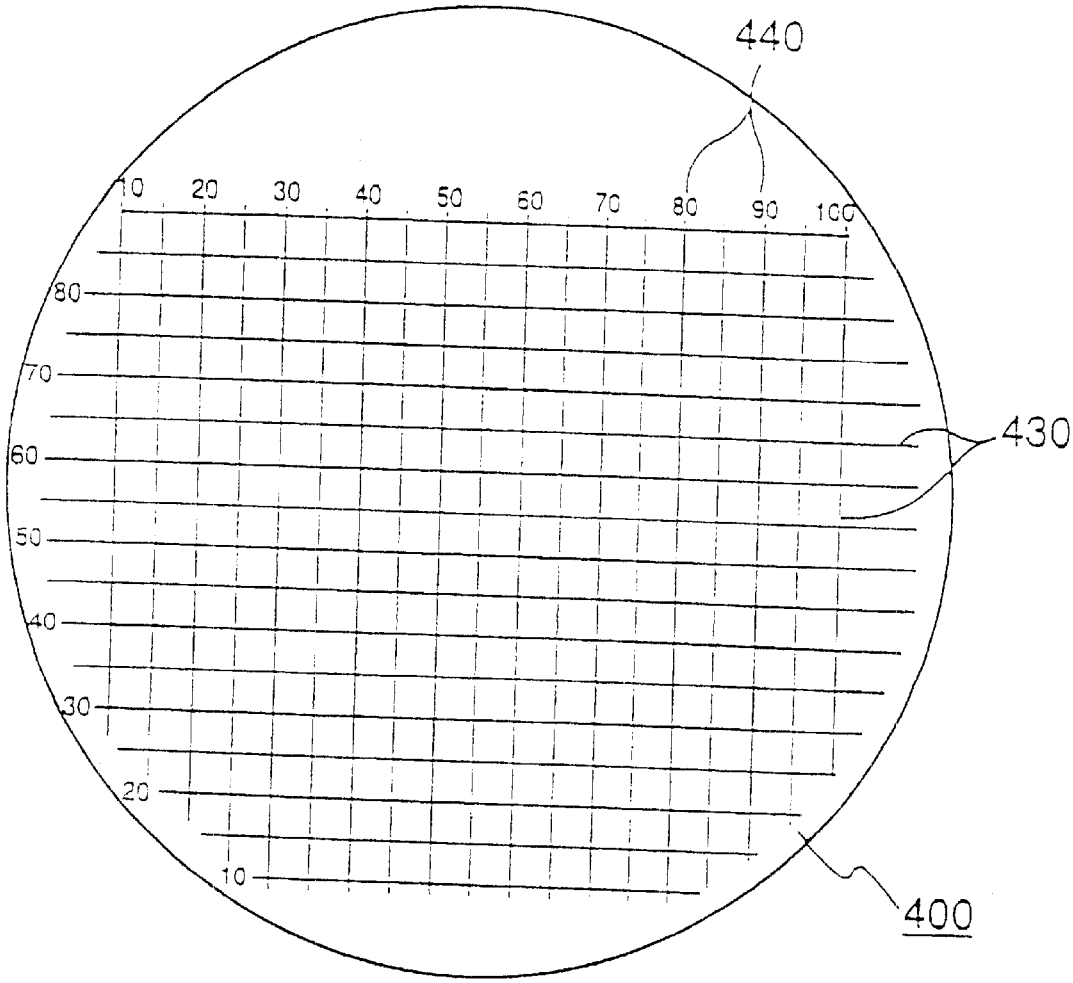

【Fig. 4d】
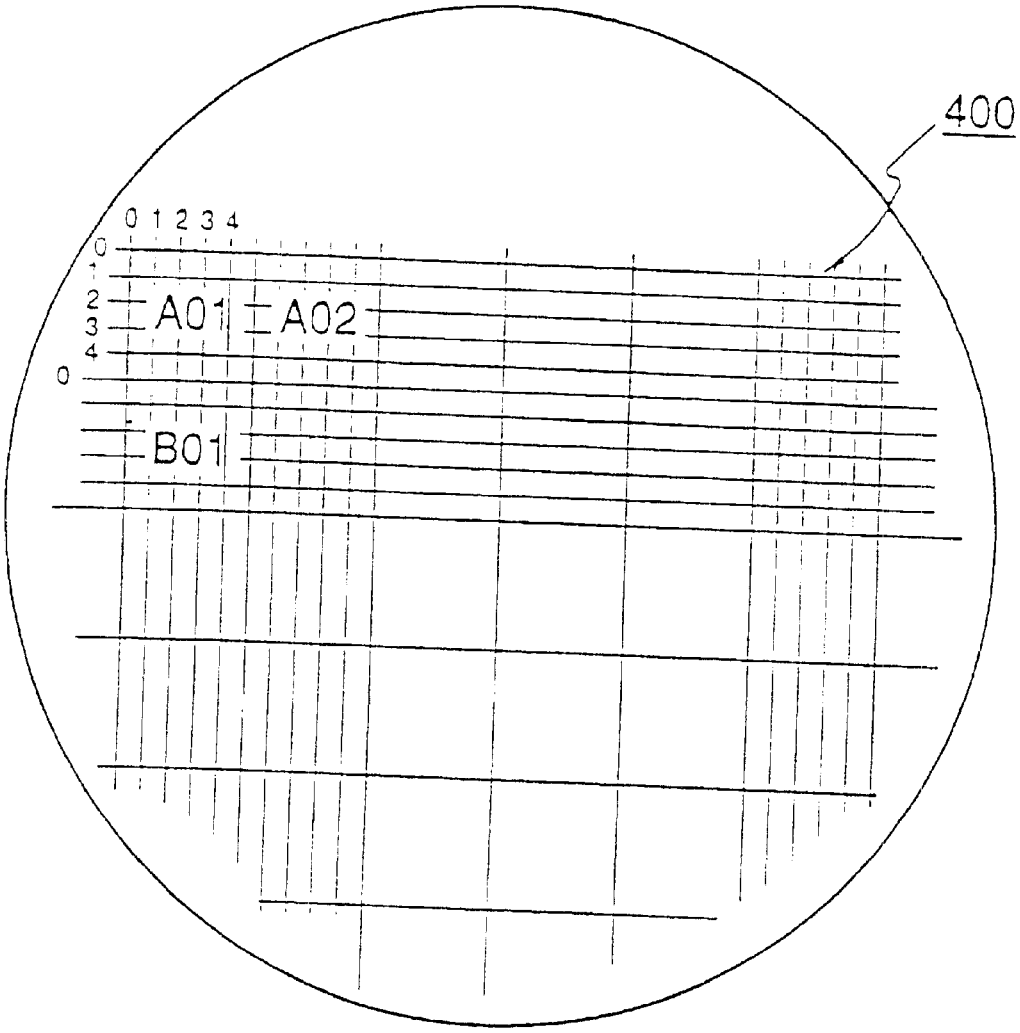

【Fig. 5】
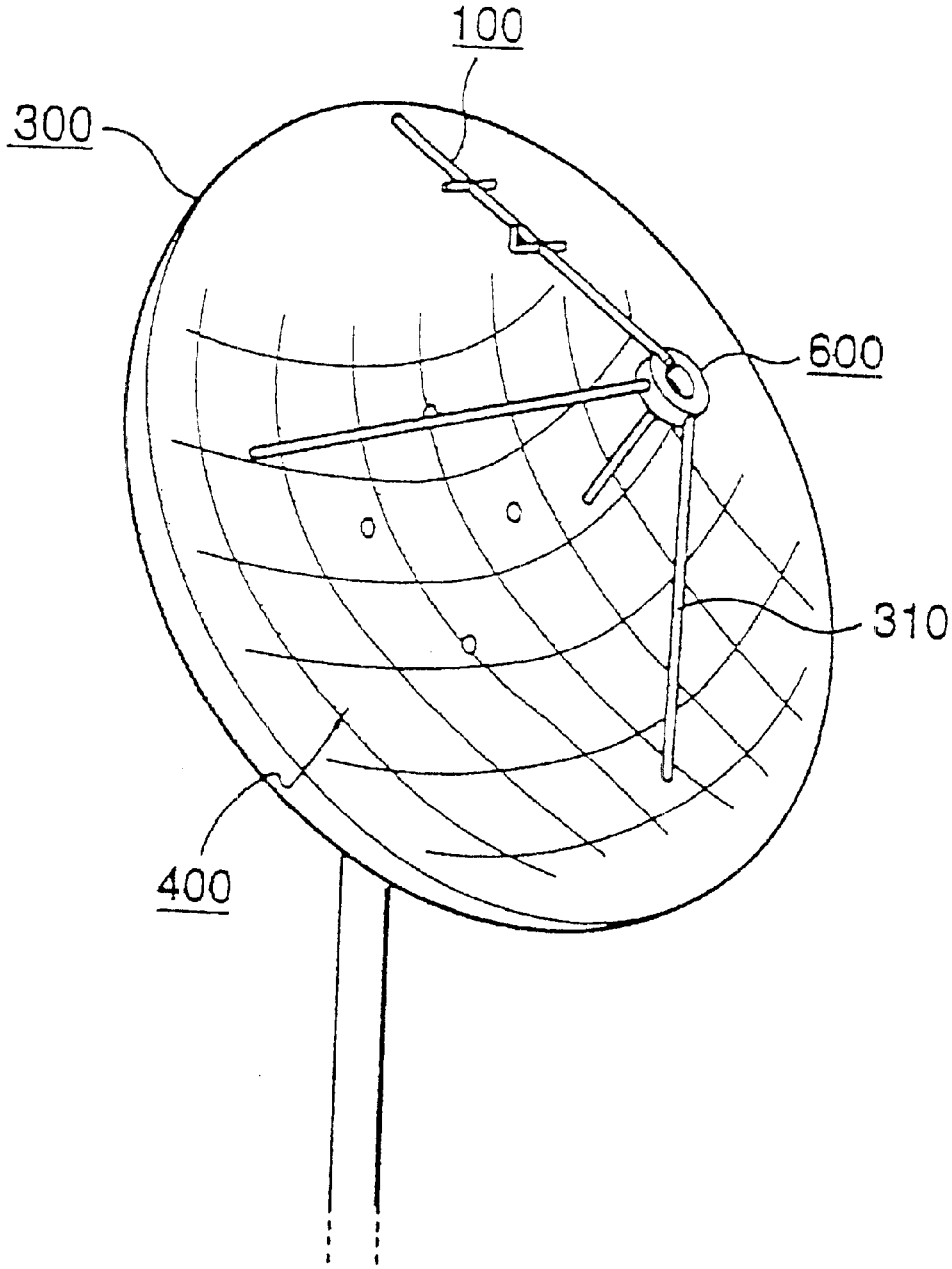

【Fig. 6a】
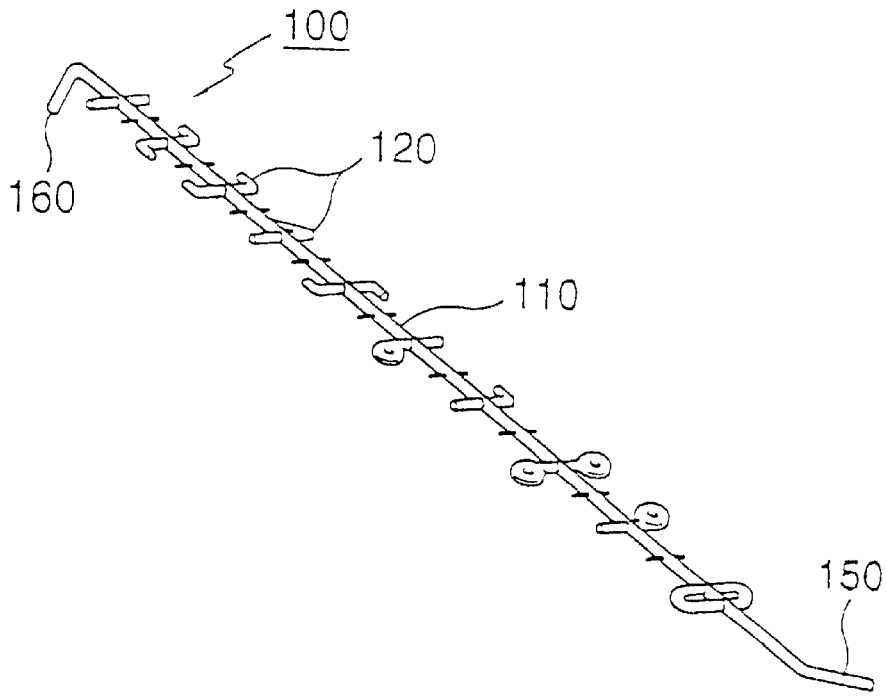
【Fig. 6b】
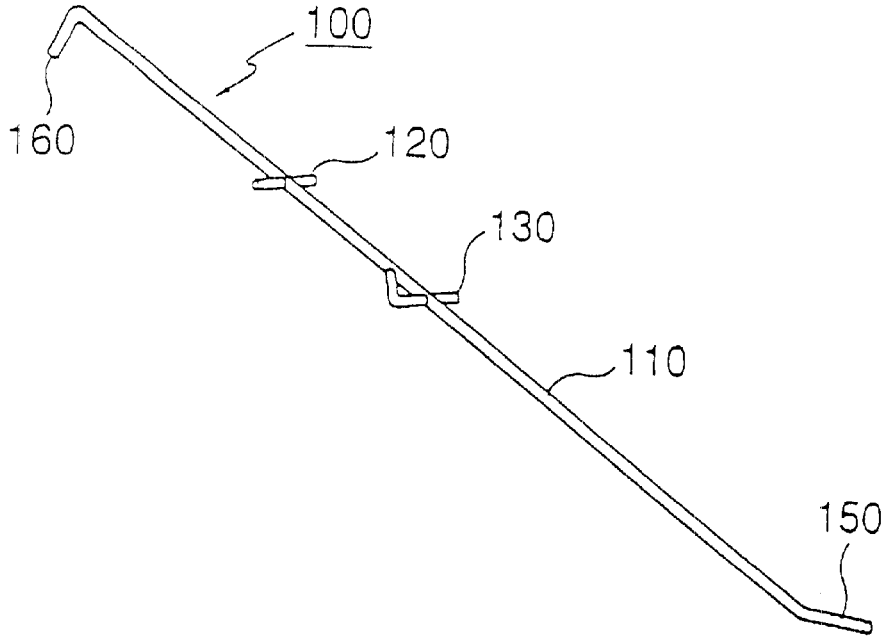

【Fig. 6c】
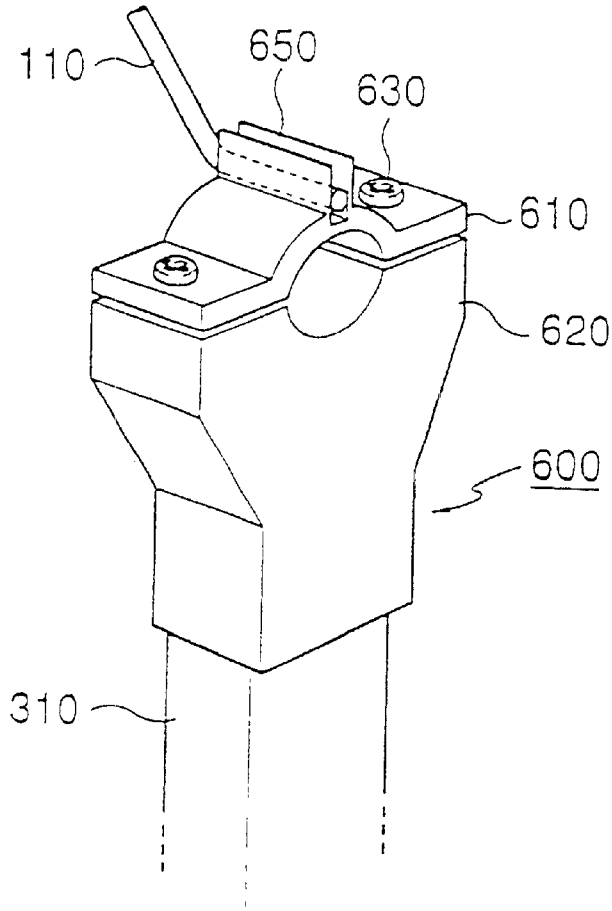
【Fig. 6d】
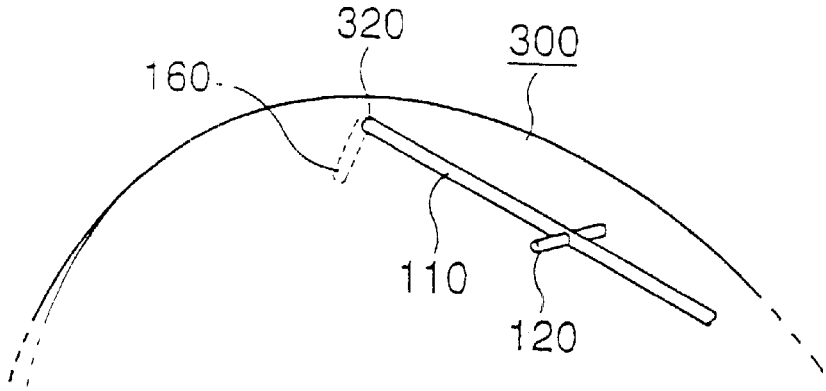

【Fig. 7】
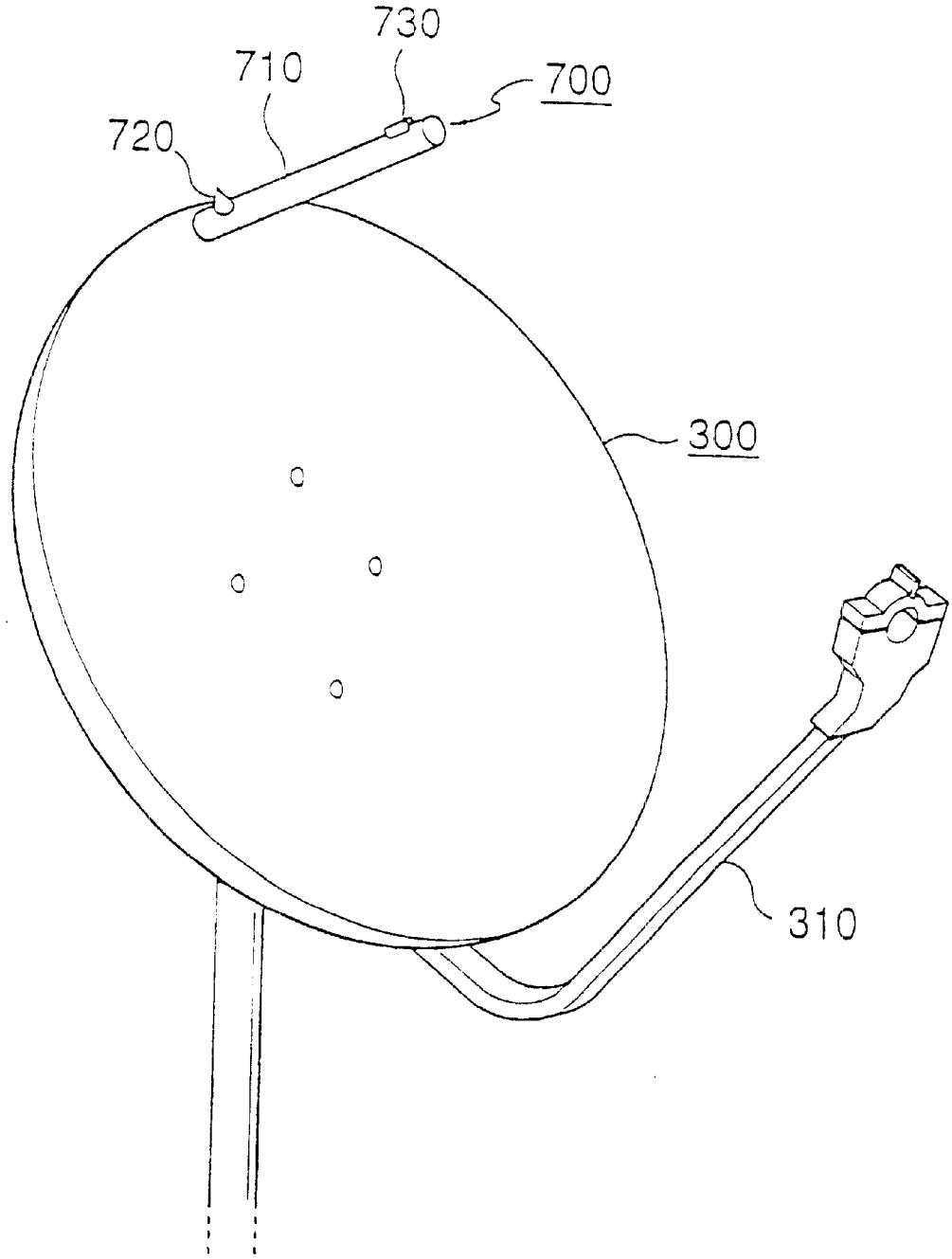

【Fig. 8】
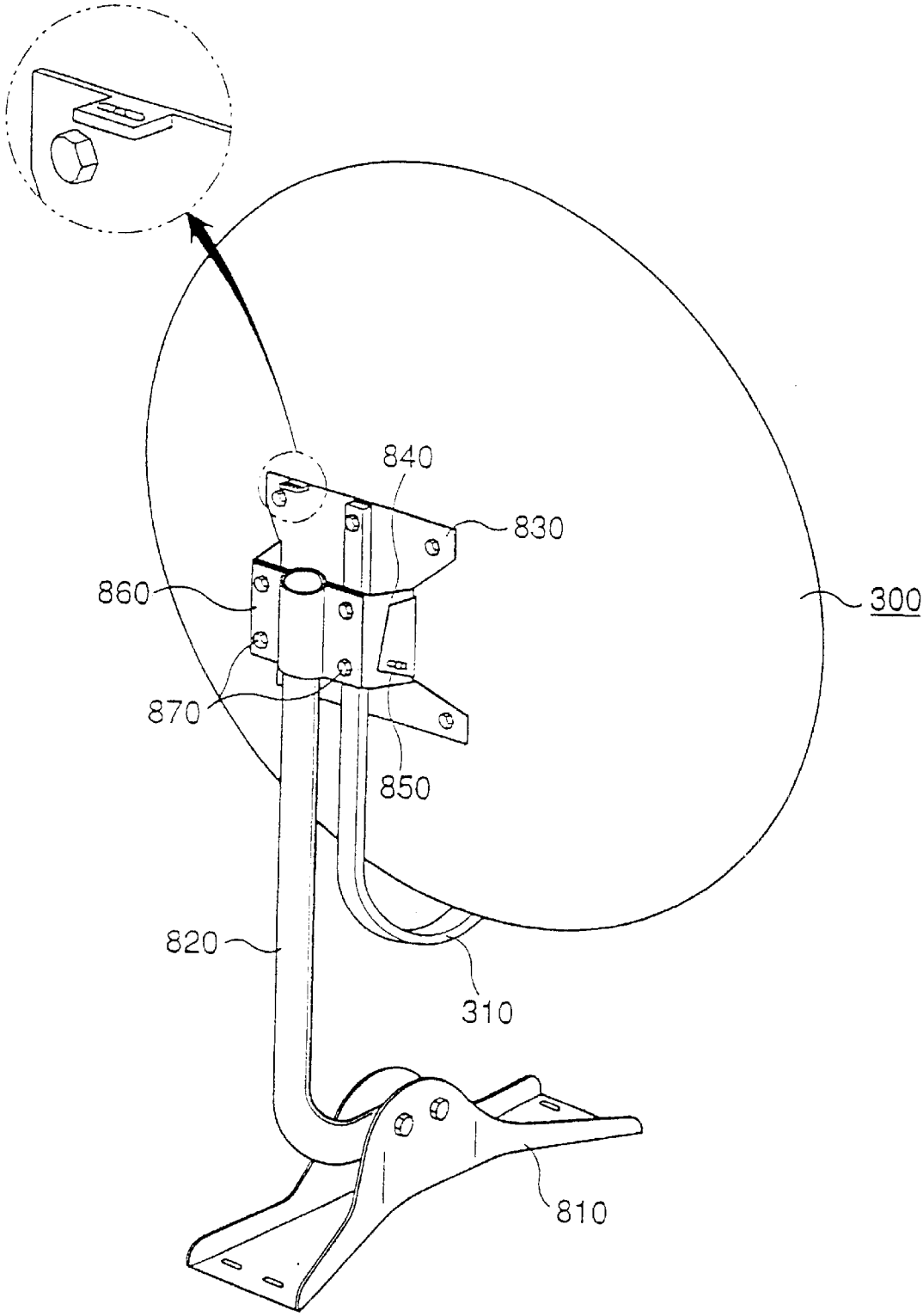

METHOD AND APPARATUS FOR ANTENNA ORIENTATION AND ANTENNA WITH THE SAME

TECHNICAL FIELD

The present invention relates to an apparatus and a method for orienting an antenna to a signal transmitter using the shadow of the sun, and an antenna using the apparatus, more particularly, to an apparatus and a method for orienting an antenna to a signal transmitter with which the antenna is easily directed toward the transmitter by generating the shadow of the sun and adjusting the antenna so that the shadow coincides with a predetermined target point on a reflector.

BACKGROUND ART

Recently, as satellite broadcasting is popular, there are increased viewers who watch satellite broadcasting. As well known to those skilled in the art, a dipole antenna, a horn antenna, a reflector antenna and a phase-array antenna may be enumerated as examples of antennas for receiving broadcasting satellite signals.

Among them, a reflector antenna (so called, "a dish antenna") which is generally used as a satellite antenna is simple in structure, is light and is easy to install. The reflector antenna comprises a base or bracket, a support post extended vertically upwards from the base or bracket, and an antenna assembly supported on the top of the support post. The antenna assembly comprises a dish-shaped reflector that reflects a signal, a reflected signal pickup unit including a feed horn positioned at a specific position relative to the reflector, and a Low Noise Block (LNB) to which the signal fed from the feed horn is inputted. In order to position the reflected signal pickup unit with regard to the reflector, a reflected signal pickup unit supporting arm is employed. On the end of the signal pickup unit supporting( arm, there is provided with a pickup unit holder for fixing the signal pickup unit. A signal from the LNB is inputted to a receiving unit of a television set through a cable.

Such a reflector has a flat or curved, preferably parabolic surface and various sizes in accordance with use. The feed horn and the LNB constituting the signal pickup unit may be located over a center of the reflector (a central feeding type), or may be located at an eccentric position so as to prevent the feed horn and the LNB from hindering a received signal (an offset feeding method). The feed horn and the LNB are preferably spaced apart from the reflector by the focal distance of the reflector. In addition, according to the method of collecting a signal and the shape of the reflector, the antennas may be classified into a parabolic antenna, a Cassegrain antenna, a Gregorian antenna and a horn reflector antenna.

These various antennas should have a high gain, a high efficiency and a high directivity to be employed as a satellite antenna. Furthermore, since a broadcast signal that is transmitted from a satellite rotating with the earth has a high, directivity, the satellite antenna should be precisely oriented toward the satellite. The allowable orientation angle tolerance is below 5°. Therefore, differing from an antenna for an aerial wave broadcasting, when the orientation angle of the satellite antenna is deviated from the allowance range, the antenna cannot receive the broadcast signal, and when the broadcast signal is digital, the directivity of the signal is more restricted.

Due to the high directivity of the satellite broadcast signal, the installation of the satellite antenna is difficult. That is, one person should adjust the direction of the satellite antenna while another person monitors a television set and confirms whether a good image is obtained or not.

Recently, there is proposed a method in which the direction of the satellite antenna is adjusted by means of a graduator and a compass on the basis of the position information (altitude and azimuth) of a satellite obtained through a computer program or a table. Additionally, there is proposed another method in which the direction of the satellite antenna may be precisely adjusted using a level meter, after the rough direction of the satellite antenna is first determined using the above-described method.

In U.S. Pat. No. 5,589,841, there is disclosed a technique in which a user may orient properly a satellite antenna by himself using an auxiliary device generating a human-perceptible guidance signals such as a sequence of beep tones, in proportion to the strength of the received broadcast signal without monitoring a television set. However, these auxiliary adjusting devices may not be attached to the satellite antenna permanently and the cost of the satellite antenna having these auxiliary adjusting devices is increased because the devices are very complex. Additionally, since such an adjusting device may be difficult to operate, an expert is required for installing and adjusting an antenna and, therefore, the cost of the installation and adjustment becomes increasing. Furthermore, when the direction of the satellite antenna is changed due to careless use or environmental causes after the satellite antenna is initially installed, an expert should be called to adjust the direction of the satellite antenna, which incurs an additional cost.

Of course, a non-directional satellite antenna or an satellite antenna having an electromotive orienting apparatus may be employed, but such an antenna may not be widely used because the structure of the antenna is complex and the cost of the antenna is too high.

In order to overcome this problem, there is suggested a method in which a relative position of a satellite with regard to the sun is determined and a satellite antenna is oriented toward the satellite using the shadow of the sun. One example of such methods is "The Sunshine-Shadow Method of Locating Satellite and Boresighting Dishes", Satellite Retailer; Triple-D Publishing, Shelby, N.C., December, 1995. U.S. Pat. No. 5,760,739 invented by Richard A. Pauli disclosed a similar method in that an adjustable gnomon is mounted to a satellite antenna, setting information is calculated based on the relative position of a satellite with regard to the sun, the gnomon is two-dimensionally or three-dimensionally adjusted based on the setting information, and the direction of the satellite antenna is adjusted until the shadow of the gnomon becomes a point.

As an embodiment of the above invention of U.S. Pat. No. 5,760,739, a device for adjusting a gnomon along two axes or three axes is disclosed. However, according to the embodiment, a mechanical device, such as a warm gear, is employed so as to adjust the gnomon. However, such a mechanical device does not allow the directional precision, since a directional allowance angle for the satellite antenna falls within 1–2°. Additionally, since the size of the mechanical device should be large so as to adjust the gnomon along two-axes or three-axes, the device may be an obstacle in receiving the broadcast signal, thereby reducing the intensity of receiving the signal.

In another embodiment of the above invention of U.S. Pat. No. 5,760,739, a device in which two lines intersecting at specific points in a plane formed by the rim of the reflection dish are attached to the reflection dish and a satellite antenna are adjusted until the intersecting point of the shadow of the lines coincides with a predetermined target. Though such an adjusting device does not affect an intensity of receiving a broadcast signal, however, when the radius of curvature of the reflection dish is very large so that the surface of the reflection dish is close to a imaginary plane defined by the periphery of the dish, the distance between the lines and their shadow is too small. Therefore, although the directional angle is changed much, the movement of the shadow is not long, thereby causing difficulty in orienting the antenna toward the satellite precisely.

Furthermore, these two embodiments cause a problem in which a user should adjust the gnomon or the lines according to setting information that is calculated differently with dependence on the installation time and the installation position of the satellite antenna. These also cause a problem in which a user who has insufficient scientific knowledge may have difficulty in adjusting the gnomon or lines according to the pre-calculated altitude and azimuth.

In a further embodiment of U.S. Pat. No. 5,760,739, a gnomon is fixed, a track line that the shadow of the gnomon makes over time and a straight time line that corresponds to a particular time of the antenna installation are provided on a surface of the reflector, and a reflection dish is adjusted so that the shadow of the gnomon coincides with the intersecting point of the selected two lines. However, according to the latitude and longitude of a location at which the satellite antenna is installed, the shadow track line may vary differently and time line is given differently. That is, since the lines are formed differently depending on season, date and the location of the installation of the antenna, this embodiment may not used for all the installation and time. Consequently, this embodiment can be used only when the satellite antenna is installed at a limited location and time. Therefore, when the antenna is installed beyond the above-defined limitation, this embodiment may not be available at all. In addition, since the gnomon is located over the center of the reflection dish, the gnomon hinders the reception of a broadcast signal. Further, when the gnomon is close to the reflection dish, the distance between the gnomon and its shadow is short, thereby deteriorating the directional precision.

DISCLOSURE OF THE INVENTION

Accordingly, the present invention has been made keeping in mind the above problems occurring in the prior art, and an object of the present invention is to provide a method of orienting a satellite antenna toward a transmitter using the shadow of the sun, allowing a non-skilled user to easily adjust the direction of the satellite antenna toward the satellite without reducing the performance of the reception of a broadcast signal.

Another object of the present invention is to provide an apparatus for orienting a satellite antenna toward a transmitter, capable of easily orienting the satellite antenna to the transmitter without using a complex antenna orienting apparatus, which may be achieved by means of a shadow generating means and a target indicating means because the shadow of the sun is easily generated and the antenna is easily adjusted so that the shadow coincides with a target point on a reflector.

A further object of the present invention is to provide a reflector satellite antenna equipped with such an antenna orienting apparatus, capable of easily orienting an antenna toward a transmitter and easily installing an antenna.

In order to accomplish the above object, the present invention provides an apparatus for orienting an antenna toward a transmitter, which is used with an antenna, comprising shadow generating means fixedly mounted to the antenna so as to generate a shadow of the sun, and target indicating means for specifying a target point on a reflector, at which a predetermined portion of the shadow generated by the shadow generating means should be positioned when the antenna is correctly oriented toward the transmitter.

In addition, the present invention provides a method for orienting an antenna toward a transmitter, which is used with an antenna, comprising the steps of mounting a shadow generating means to the antenna, determining a target point on the reflector, at which a predetermined part of the shadow generated by the shadow generating means should be positioned when the antenna is correctly directed toward the transmitter, on the basis of the type of a satellite (including the position thereof), location information of the antenna and time information of an antenna orienting operation, and adjusting a direction of the antenna so that the predetermined part of a shadow generated by the shadow generating means coincides with the target point.

Furthermore, the present invention provides an antenna comprising an antenna assembly having a reflector that reflects a signal, a reflected signal pickup unit which consists of a feed horn and a low noise block (LNB) and feeds a reflected signal, a signal pickup unit supporting arm that supports and positions the reflected signal pickup with regard to the reflector, and a pickup unit holder that is mounted to an end of the signal pickup unit supporting arm and supports the reflected signal pickup unit, means for supporting the antenna assembly, and an adjustable mounting mechanism for adjusting the antenna assembly in two directions, wherein the antenna further includes a shadow generating means fixedly mounted to the antenna so as to generate a shadow of the sun, and target indicating means provided on the reflector for indicating a target point at which a predetermined part of the shadow generated by the shadow generating means should be positioned when the antenna is correctly oriented toward the transmitter.

The shadow generating means may consist of a bar that is fixed at its first end to a reflected signal pickup unit or pickup unit holder of the antenna and is fixed at its second end to a periphery of the reflector, and one or more projecting marks formed on predetermined parts of the bar. And, the target indicating means may consist of a set of a plurality of intersectional lines that are provided on a surface of the reflector. The target point may be specified by coordinate values defined by the intersectional lines and/or one of blocks that are formed by the intersectional lines.

According to another embodiment, the shadow generating means may consist of a bar that is fixed at its first end to a reflected signal pickup or pickup holder of the antenna and is fixed at its second end to a periphery of the reflector, and a plurality of projecting figure-shaped graduations formed on the bar. And, the target indicating means may consist of one or more lines provided on the surface of the reflector with forming an angle with shadow generating means and marked with graduations. In this embodiment, the target point on the target indicating means may be specified by two coordinate values that are determined by an intersection point at which a shadow of the bar of the shadow generating means intersects the line(s) of the target indicating means.

The apparatus and the antenna may comprise a level that is mounted to the antenna and serves to confirm whether the support post for supporting the antenna assembly is perpendicularly positioned relative to an antenna installation site when viewed from the front. In addition, the apparatus and the antenna may include an obstacle observing means consisting of a rod that is extended from a portion of the reflector along an antenna orienting direction, and a foresight and a backsight that are spaced apart from each other and are formed on the rod.

In the method of the present invention, determining the target point on the target indicating means, at which a predetermined portion of a shadow should be positioned, may be performed by a computer program, which determines the target point on the basis of the type of a satellite, location information of the antenna and/or time information of an antenna orienting operation.

The method may further comprise the steps of confirming whether the antenna is positioned in an initial reference state in which a support post of the antenna is perpendicularly positioned, and adjusting the antenna to be in the initial reference state when the antenna is not in the initial reference state.

The method may further comprise the step of confirming whether there is an obstacle hindering the reception of the signal in an antenna orienting direction after the direction of the antenna is adjusted toward the transmitter.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a drawing that explains a basic principle of a method for orienting a satellite antenna according to the present invention and, in more detail, explains a method for determining the relative position information of an antenna, the sun, and the satellite as a transmitter using a spherical trigonometry;

FIG. 2 is a perspective showing the construction of a general parabolic satellite antenna;

FIGS. 3*a*–3*c* illustrate an antenna orienting apparatus according to a first embodiment of this invention, FIG. 3*a* is a perspective view of the apparatus, FIG. 3*b* is a side view of the apparatus, and FIG. 3*c* is a front view of the apparatus;

FIGS. 4*a*–4*d* illustrate an apparatus and a method for orienting a satellite antenna toward a transmitter according to a second embodiment of the present invention, FIG. 4*a* is a perspective view of the apparatus, FIG. 4*b* is a front view of the shadow generating means of the apparatus, FIG. 4*c* shows a first example of a target indicating means of the antenna orienting apparatus, and FIG. 4*d* is a plan view showing a second example of the target indicating means of the antenna orienting apparatus;

FIG. 5 is a perspective illustrating another embodiment in which the apparatus and the method for orienting an antenna to a transmitter according to this invention are applied to a central feeding type antenna;

FIGS. 6*a*–6*d* are enlarged views showing two examples of shadow generating means according to this invention and the connection state of the bar of the shadow generating means, FIG. 6*a* is an enlarged perspective view showing the shape of the shadow genertating means according to the first embodiment of this invention, FIG. 6*b* is an enlarged perspective view showing the shape of the shadow generating means according to the second embodiment of this invention, FIG. 6*c* is a view showing the connection part between the lower end of the bar of the shadow generating means and the pickup unit holder, and FIG. 6*d* is a view showing the connection part between the upper end of the bar of the shadow generating means and the periphery of the reflection dish;

FIG. 7 is a perspective view shoving an obstacle observing means that may be added to the antenna orienting apparatus; and FIG. 8 illustrates the rear part of the antenna wherein the reflection dish and the pickup unit supporting arm are connected with the support post.

DETAIL DESCRIPTION OF THE INVENTION

Referring to FIGS. 1–8, a preferred embodiment of the present invention is described in detail.

FIG. 1 is a drawing for explaining a basic principle of a method of orienting a satellite antenna to the transmitter according to the present invention and, in more detail, explaining a method of determining the relative position information of an antenna, the sun and the transmitter using a spherical trigonometry. When the altitudes of the sun and a broadcast satellite are respectively denoted as $H_{sun}$ and $H_{sat}$ and the azimuth angles of the sun and the broadcast satellite are respectively denoted as $Z_{sun}$ and $Z_{sat}$, the relative location of the satellite with regard to the sun may be designated with two angles of H and Z in a spherical coordinate system as illustrated in the drawing. The altitude and the azimuth angle of the sun depending on the region on the earth and time are given already, and the altitude $H_{sat}$ and azimuth angle $Z_{sat}$ of the broadcast satellite may be determined from the longitude, the latitude and the height of the satellite. Therefore, the values of H and Z in accordance with the location and time of the antenna installation operation may be determined according to the following equations.

$$H=\cos^{-1}\{\sin H_{sat}*\sin H_{sun}+*\cos H_{sat}*\cos H_{sun}*\cos(Z_{sat}+Z_{sun})\}Z=\sin^{-1}\{\cos H_{sun}*\sin(Z_{sat}-Z_{sun})/\cos H\} \quad \text{[Equation 1]}$$

Using these equations, the relative location of the satellite with regard to the sun is determined. As will be described, the relative location is basic information on a coordinate at which the sun or it's shadow is located when the reflection dish is directed toward the satellite.

FIG. 2 is a perspective view illustrating the construction of a general parabolic satellite antenna. The satellite antenna includes a base 810 or bracket, and a support post 820 that is extended vertically upwards from the base 810 or bracket. An antenna assembly is mounted to the top of the support post 820. The antenna assembly comprises a reflector 300 that reflects a signal and is dish-shaped, a feed horn 210, and a Low Noise Block (220; LNB) to which the signal fed in the feed horn 210 is inputted. The feed horn 210 and the LNB 220 constitute a reflected signal pickup unit 200 Which is positioned at a specific position in relation to the reflector 300. In order to appropriately position the reflected signal pickup unit with regard to the reflector 300, a signal pickup unit supporting arm 310 is employed. The signal pickup unit supporting arm 310 is provided at its one end with a pickup unit holder 600 for holding and fixing the signal pickup unit 200. The feed horn 210 and the LNB 220 constituting a reflected signal pickup unit 200 may be integrated into a single body or be separated.

FIGS. 3*a*–3*c* illustrate the antenna orienting apparatus according to a first embodiment of this invention. As illustrated in FIG. 3*a*, the general construction of a satellite antenna is included in the embodiment. For ease of description, the illustration of the reflected signal pickup 200 is omitted. The antenna assembly includes the reflector 300 made of conductive material, the signal pickup unit supporting arm 310 for fixing the reflected pickup unit 200 at a specific position, and the pickup unit holder 600 for fastening the signal pickup unit 200. Additionally, the antenna includes an adjustable mounting mechanism (not shown) for adjusting the reflector in the horizontal direction (in the azimuth direction) and in the vertical direction (in the altitude direction) and the support post 820 for supporting the antenna assembly.

The antenna orienting apparatus according to the first embodiment generally comprises a shadow generating means 100 and a target indicating means 400. The shadow generating means 100 consists of a bar 110 that is fixed at its one end (lower end) to the reflected signal pickup unit 200 or signal pickup unit holder 600 and is fixed at its other end (upper end) to the periphery of the reflection dish 300, and a plurality of projecting figure-shaped graduations. The bar 110 may be made of metal, but should be preferably made of material that is easily restored to its original shape after being deformed because it has a good elasticity. The upper end of the bar 110 is preferably bent in the form of a hook so as to be inserted and fixed to a hole 320 formed in the upper portion of the periphery of the reflection dish 300. The thickness of the bar 110 is designed to maintain its linear shape when mounted to the antenna. However, since the bar 110 may hinder the reception of the signal when the thickness of the bar 110 is excessively large, the thickness of the bar 110 is preferably 1 to 10 mm and, more preferably, 2 to 5 mm.

According to the first embodiment, projecting figure-shaped graduations 120 should be formed on the bar 110 at regular intervals. The projecting figure-shaped graduations 120 may be formed as illustrated in FIG. 6*a*. As occasion demands, the intervals between the adjacent projecting graduations may be divided more precisely.

The lower end portion of the bar 110 is bent to form a certain angle with the middle portion of the bar 110 so as to be fixed to the reflected signal pickup unit 200 or the pickup unit holder 600. The detailed shape and the connecting portions of shadow generating means 100 are described with reference to FIGS. 6*a*–6*d* in the following. Since the bar 110 is mounted between the reflection dish 300 and the pick unit holder 600 as described in the above, the bar 110 becomes spaced apart from the surface of the reflection dish 300, thereby improving a directional accuracy.

The shadow target indicating means 400 provided on the reflection dish 300 is used for specifying a target point at which a predetermined part of the shadow should be positioned, the shadow being generated by the shadow generating means 100 when the antenna directing apparatus is properly mounted to the reflection dish 300. The target indicating means 400 is formed on the surface of the reflection dish 300 and includes a target line 410 that forms an angle (preferably, 90°) with the mounted shadow generating means 100. A plurality of graduations is marked along the target line 410. Corresponding numerical values 420 are marked at corresponding graduations.

The target point at which the predetermined part of the shadow should be located when the antenna is correctly oriented toward the transmitter may be obtained using transmitter information including the type of the satellite and a receiving channel, antenna installation location information including the latitude and the longitude of the antenna installation area, and antenna installation time information including the year, the month, the date and the time when antenna orienting operation is performed. The determination of the target point on the target indicating means may be performed by means of a computer program. The computer program may be installed in a television set so that a user may perform the determination of the target point by manipulating the functions of the television set, or may be installed in an independent computer so that the user may perform the determination of the target point by operating the corresponding program in the computer. Otherwise, the determination of the target point may be performed in such a way that the user access to a related website, the user inputs the required information and the website server return a result of the target point to the user. The determination of the target point may be easily performed in various another ways, for example, a way in which related information in accordance with the type of satellite is arranged in a table and the table is provided together with the satellite antenna.

When the shadow of the bar of the shadow generating means 100 intersects the target indicating means 400 at a point, the intersection point is defined by a graduation value formed on the bar 110 and a graduation value marked on the target indicating means 400 in the first embodiment. That is, the target point is specified by two graduation values. Therefore, for example, when a coordinate of the target point is determined as (2.5, 4.3) according to location information and time information of the antenna orienting operation, the satellite antenna should be adjusted in the azimuth direction and the altitude direction so that the intersection point substantially coincides with the position of (2.5, 4.3).

FIGS. 4*a*–4*d* are views illustrating an apparatus and a method for orienting a satellite antenna toward a transmitter according to a second embodiment. The general construction of the satellite antenna of FIG. 4*a* is identical to that of the satellite antenna of FIG. 3*a* except the shape of the shadow generating means and target indicating means. Similar to the first embodiment, a shadow generating means according to the second embodiment includes a bar 110, the bar 110 is fixed to the upper portion of a reflected signal pickup unit holder 600 at its one end and is fixed to the tipper periphery portion of the reflection dish 300 at its other end. However, unlike the first embodiment, one or more projecting marks are formed on the bar 110. In FIG. 4*a*, two separate projecting marks, that is, a cross-shaped mark 130 and a bent mark 140 are formed on the bar 110. These marks have no limitation in shape and number, but should be distinguishable from each other and specify their own position on the bar 110.

FIGS. 4*c* and 4*d* are plan views showing target indicating means 400 according to the second embodiment. The target indicating means 400 consists of a set of a plurality of intersectional lines 430 provided on the surface of the reflection dish. In this embodiment, each of the lines 430 has own numerical value. A specific position on the reflection dish 300 may be defined by a coordinate (a horizontal coordinate x, a vertical coordinate y) that is defined by two intersecting lines.

However, the position on the reflection dish 300 may not be defined by a coordinate, but may be defined by one of codes that are assigned to rectangles formed by intersecting lines, for examples, A01, A02, . . . , B01, B02, . . . . Therefore, for example, the target point at which the shadow should be positioned may be designated by the term of F09 in this embodiment.

According to another method, as shown in FIG. 4*d*, a plurality of intersectional lines are drawn on the reflection dish 300 at 5 cm intervals and codes (A01, A02, . . . , B01, B02, . . . ) are respectively assigned to the 5 cm×5 cm blocks.

Multiple auxiliary intersectional lines may be drawn at 1cm intervals so that each of the 5 cm×5 cm blocks may be divided into 25 of 1 cm×1 cm blocks. In such an embodiment, for example, a target point may be designated as "an abscissa 1.2 and an ordinate 3.4 of a block D03". According to tests, with respect to most of satellites (for an antenna with a dish of 45 cm radius), when the predetermined portion of the shadow is positioned within a circle with a radius of 0.5 cm centering a correct target point, the receiving performance of a broadcast signal is satisfactory. Therefore, the formation of 1 cm×1 cm blocks is sufficient for the target indicating means 400 to specify the satisfactory target point.

Additionally, since orienting operation of the antenna requires some time, multiple target points over 10 to 30 minutes may be provided. For example, in addition to a target point information with regard to a time that a user selects, the target point information for 5 minutes and/or 10 minutes prior to the selected time, and the target point information for 5 minutes and/or 10 minutes after the selected time are provided together. As a result, although the user spends some time in adjusting the satellite antenna, it is not required to calculate another target point information again.

FIG. 5 is a perspective view showing another embodiment of the present invention wherein an apparatus and a method for orienting an antenna toward a transmitter according to this invention is applied to a central feeding type antenna. In view of its principle, this embodiment is similar to the first and second embodiments shown in FIGS. 3*a* and 4*a*. Since a pickup unit holder 600 to hold a reflected signal pickup unit consisting of a feed horn and an LNB is positioned over the center of the reflection dish 300, a bar 110 constituting a shadow generating means 100 is extended from the upper periphery portion of the reflection dish 330 to a portion of the pickup unit holder 600 or the pickup unit. Therefore, this embodiment is different from the first and second embodiments in the length of the bar and the position of the installation of the bar, but is similar to the first and second embodiments in the construction of a shadow generating means, an its installation and a target indicating means 400.

FIGS. 6*a*–6*d* are enlarged views showing the constructions of shadow generating means according to this invention. FIGS. 6*a* and 6*b* are enlarged perspective views showing the construction of the shadow generating means according to the first embodiment and the second embodiment of this invention, respectively.

As shown in FIG. 6*a*, the bar 110 constituting the shadow generating means 100 is provided with multiple projecting graduations 120 that respectively have values of 1 to 10 and intermediate graduations are respectively formed between adjacent two projecting graduations 120. By virtue of this construction, the coordinate of the intersecting point at which the shadow of the bar 110 of the shadows generating means 100 intersects the line of the target indicating means may be specified. In addition, one end 160 of the bar 110 is preferably bent so as to be inserted into the hole formed on a periphery portion of the reflection dish 300, and the other end 150 of the bar 110 is preferably bent slightly so as to be fixed to the reflected signal pickup unit holder.

As shown in FIG. 6*b*, in the second embodiment, the shadow generating means comprises a bar 110 that is bent at its both ends and includes two projecting marks 120 and 130. The projecting marks consist of the cross-shaped mark 120 and the bent mark 130.

FIG. 6*c* illustrates the connection between the bar 110 of the shadow generating means 100 and the pickup unit holder 600. The reflected signal pickup unit consisting of the feed horn and the LNB fixed by means of the pickup unit holder 600 so as to be positioned at a specific position with respect to the reflection dish 300. Such a pickup unit holder 600 consists of an upper holder 610, a lower holder 620 and a fixing screw 630. The neck between the feed hone and the LNB is positioned between the upper holder 610 and the lower holder 620 and the upper holder 610 and the lower holder 620 are fastened by means of the fixing screw 630. In order to hold the bar 110 of the shadow generating means 100, a clip 650 is formed on the top of the upper holder 610. The bar 110 is fixed to the pickup unit holder 600 by inserting the one end of the bar 110 into the clip 650. As long as the clip 650 fastens the end of the bar 110, the clip 650 has no limitation in shape. That is, the clip may be replaced with another means that may fix the end of the bar 110 to the pickup unit holder 610.

FIG. 6*d* illustrates the connection between the bar 110 of the shadow generating means 100 and the reflection dish 300. In the drawing, a hole 320 is formed on the upper portion of the periphery of the reflection dish 300 and the bent end 160 of the bar 110 is inserted into the hole 320. On the other hand, since the other end 150 of the bar 110 is fixed to the upper portion of the pickup unit holder 600, the bar 110 is mounted stably to the satellite antenna.

However, the fixing construction of the bar 110 is not limited to the above, but may be appropriately modified according to the structure of the satellite antenna.

FIG. 7 is a perspective showing an obstacle observing means that may be added to the antenna orienting apparatus. Even though the satellite antenna is oriented properly toward a satellite by means of the antenna orienting apparatus, the reception of a broadcast signal may be hindered when there is an obstacle in the antenna orienting direction. In such a case, the position of the satellite antenna should be changed to receive the broadcast signal sufficiently. Therefore, the obstacle observing means 700 is required to observe the obstacle in the antenna orienting direction. As shown in FIG. 7, the obstacle observing means 700 comprises a rod 710 that is extended from a portion of the periphery of the reflection dish 300 along the antenna orienting direction, a backsight 720 formed on the rear portion of the rod 710, and a foresight 730 formed on the front portion of the rod 710. The obstacle observing means utilizes the known technique of aiming a firearm. After adjustment of the antenna direction using the shadow of the sun, a user aligns the backsight 720 and the foresight 730 and observes an obstacle in the direction that passes through the backsight 720 and the foresight 730.

In addition, when the obstacle observing means 700 is mounted on the upper portion of the reflection dish 300, the end of the bar 110 of the shadow generating means 100 may be fixed to a portion of the rod 710 of the obstacle observing means 700 instead of the reflection dish 300.

FIG. 8 illustrates a rear portion of the antenna assembly wherein the reflection dish 300 and the pickup unit supporting arm 310 are connected with the support post 820. In the drawing, the pickup unit supporting arm 310 and a fixing plate 830 are fixed on the rear surface of the reflection dish 300 by means of fixing screws. The fixing plate 830 is adjustably connected to an altitude adjusting plate 840 by means of an altitude adjusting screw 850. The support post 820 is positioned between the altitude adjusting plate 840 and a post adjusting plate 860 and is fixed by means of an azimuth adjusting screw 870. The lower end of the support post 820 is connected with the base 810. The base 810 is fixed to an appropriate place such as the roof or wall of a building and therefore the satellite antenna is fixed stably.

According to such an assembling structure, in order to adjust the, directions of the reflection dish 300 and the pickup unit supporting arm assembly, a user loosens the altitude adjusting screw 850 and the azimuth adjusting screw 870, adjusts the reflection dish 300 or the pickup unit supporting arm assembly toward the desired direction, and then fastens the altitude adjusting screw 850 and the azimultlh adjusting screw 870.

However, the assembling structure and the adjustable mounting mechanism are not limited to the above, but have no limitation as long as they may adjust the reflection dish 300 and the pickup unit supporting arm assembly in the two directions (that is, the altitude direction and the azimuth direction). The examples of such an assembling structure and an adjustable mounting mechanism are disclosed in U.S. Pat. Nos. 5,933,123, 5,977,922 and 5,600,336.

Additionally, since in this method for orienting a satellite antenna, when the satellite antenna is observed from the front, the support post 820 should be perpendicularly positioned relative to the installation site in order to set a reference position of the antenna. Therefore, a level used in a telescope or a surveying instrument may be preferably provided for mounted to a portion, for example, the fixing plate 830 of the antenna.

As described in FIG. 1, when relative location angles of the satellite with regard to the sun are obtained using a spherical trigonometry, the position of the shadow on the deflection dish 300 may be obtained correctly and easily in case that the inner surface of the reflection dish 300 is identical to the spherical surface of the sphere. However, since the inner surface of the actual reflection dish 300 has a parabolic or flat inner surface, it is difficult to match the position of a specific portion of the shadow With the specific target position. In order to overcome the problem, a three-dimensional rectangular coordinate system that is centered on the center of the reflection dish 300 is introduced. The coordinate (x, y, z) of the cross-shaped mark 120 of the second embodiment is determined and the coordinate (0, y', z') of the shadow of the Sun formed on a y-z plane by the cross-shaped mark 120 may be obtained. Then, an intersection point at which a straight line between the cross-shaped mark 120 and the coordinate of the shadow on the y-z plane meets with the parabola of the inner surface of the reflection dish 300 is obtained. The intersection point is a location on the reflection dish at which the shadow of the Sun formed by the cross-shaped mark should be positioned when the satellite antenna is oriented toward a transmitter. By means of such a technique, the position at which the shadow formed on the inner surface of the reflection dish by means of the shadow generating means should be located may be determined.

Industrial Applicability

As described above, the present invention provides an apparatus and a method for orienting a satellite antenna toward a transmitter, capable of easily orienting the satellite antenna to the transmitter without using a complex antenna directing apparatus because the shadow of the sun is easily generated and the antenna is easily adjusted so that the shadow coincides with a target point on a reflector.

As a result, since a non-skilled user may install the satellite antenna easily without an expert's aid and an expensive antenna directing apparatus, the cost of antenna installation may be reduced. In addition, when the direction of the satellite antenna is changed by careless use or environmental causes after the satellite antenna is initially installed, the user may re-adjust the direction of the satellite antenna easily.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for orienting an antenna toward a transmitter, the apparatus comprising:

a shadow generating means comprising a bar, having a first end, a second end, and projecting marks, mounted to the antenna so as to generate a shadow; and a target indicating means comprising a set of a plurality of intersectional lines that are provided on a surface of a reflector of the antenna, for specifying a target point on the reflector, at which a predetermined portion of a shadow generated by the shadow generating means is positioned when the antenna is correctly oriented toward the transmitter, wherein the first end of the bar is fixed at least to one of a reflected signal pickup unit and a pickup unit holder of the antenna and the second end of the bar is fixed to a portion of a periphery of the reflector; and wherein said target point is specified by one or more of coordinate values defined by the intersectional lines and one of blocks that are formed by said intersectional lines.

2. The apparatus according to claim 1, further comprising a level mounted to said antenna to confirm whether a support post of the antenna is approximately perpendicularly to an antenna installation site when viewed from a position facing the reflector.

3. The apparatus according to claim 2, further comprising an obstacle observing means comprising a rod that is extended from a portion of a periphery of the reflector along an antenna orienting direction, and a foresight and a backsight that are spaced apart from each other and are formed on the rod.

4. A method for orienting an antenna toward a transmitter using an apparatus consisting of a shadow generating means and a target indicating means, comprising the steps of:

attaching a shadow generating means to the antenna;

determining a target point on the target indicating means, on which a predetermined portion of a shadow generated by the shadow generating means is positioned when the antenna is oriented toward the transmitter, on the basis of the type of a satellite, location information of the antenna and time information of the antenna orienting operation; and adjusting a direction of the antenna so that said predetermined portion of the shadow generated by the shadow generating means coincides with the target point, wherein said shadow generating means comprises a bar fixed at a first end to at least one of a reflected signal pickup unit and a pickup unit holder of the antenna and fixed at a second end to a portion of a periphery of a reflector, and at least one projecting mark formed on said bar;

said target indicating means comprising a set of a plurality of intersectional lines provided on a surface of said reflector; and said target point specified by at least a coordinate values defined by the intersectional lines and one of blocks formed by said intersectional lines.

5. The method according to claim 4, wherein the target point is determined on the basis of at least one type of a satellite, location information of the antenna, and time information of the antenna orienting the antenna.

6. The method according to claim 5, further, comprising the steps of:

determining whether said antenna is positioned in an initial reference state in which a support post of the antenna is approximately positioned perpendicularly relative to an antenna installation site when viewed from a position facing the reflector, using a level mounted to a portion of the antenna; and adjusting said antenna to the initial reference state.

7. The method according to claim 6, further comprising the step of determining whether an obstacle is present in an antenna orienting direction using an obstacle observing means comprising a rod extended from a portion of a periphery of the reflector along the antenna orienting direction, and foresight and backsight which are spaced apart from each other and are formed on the rod.

8. An antenna, comprising, an antenna assembly comprising:

a reflector for reflecting a signal;

a reflected signal pickup unit comprising of a feed horn and a low noise block feeding a reflected signal;

a signal pickup unit supporting arm for positioning the reflected signal pickup unit at a specific position with regard to the reflector; and a pickup unit holder attached to an end of the signal pickup unit supporting arm for supporting the reflected signal pickup unit, means for supporting the antenna assembly, and an adjustable mounting mechanism for adjusting the antenna assembly in at least two directions, wherein said antenna further comprises:

a shadow generating means attached to the antenna so as for generating a shadow; and target indicating means provided on the reflector for specifying a target point on the reflector, which a predetermined portion of the shadow generated by the shadow generating means is positioned when the antenna is oriented toward the transmitter, wherein, said shadow generating means comprises of a bar that is fixed at its first end to at least one of a reflected signal pickup unit and a pickup unit holder of the antenna and is fixed at its second end to a portion of a periphery of said reflector, and at least one projecting mark formed on said bar;

said target indicating means comprising a plurality of intersectional lines that are provided on a surface of said reflector; and said target point specified by at least one coordinate value defined by the intersectional lines and a block formed by said intersectional lines.

9. The antenna according to claim 8 further comprising a level attached to said antenna to determine if a support post of the antenna is approximately perpendicular to an antenna installation site.

10. The antenna according to claim 9, further comprising an obstacle observing means comprising a rod extended from a portion of a periphery of the reflector a first direction, and a foresight and backsight spaced apart from each other and formed on said rod.

11. An apparatus for orienting an antenna toward a transmitter, the apparatus comprising:

a shadow generating means attached to the antenna so as to generate a shadow; and a target indicating means provided on a reflector of the antenna for specifying a target point on the reflector, on which a predetermined portion of the shadow generated by the shadow generating means is positioned when the antenna is oriented toward the transmitter, wherein, said shadow generating means comprises a bar attached at a first end to at least one of a reflected signal pickup unit and pickup unit holder of the antenna and at a second end to a portion of a periphery of said reflector, and a plurality of projecting figure-shaped graduations formed on the bar;

said target indicating means comprising at least one line forming an angle with the shadow generating means and marked with graduations; and said target point specified by at least two coordinate values designating an intersection point at which a shadow of the bar of the shadow generating means intersects the line of the target indicating means.

12. The apparatus according to claim 11, further comprising a level mounted to said antenna to confirm whether a support post of the antenna is approximately perpendicularly to an antenna installation site when viewed from a position facing the reflector.

13. The apparatus according to claim 12, further comprising an obstacle observing means which comprising a rod that is extended from a portion of a periphery of the reflector along an antenna orienting direction, and a foresight and a backsight that are spaced apart from each other and are formed on the rod.

14. A method for orienting an antenna toward a transmitter using an apparatus consisting of a shadow generating means and a target indicating means, comprising the steps of:

attaching a shadow generating means to the antenna;

determining a target point on the target indicating means, on which a predetermined portion of a shadow generated by the shadow generating means is positioned when the antenna is oriented toward the transmitter, on the basis of the type of a satellite, location information of the antenna and time information of the antenna orienting operation; and adjusting a direction of the antenna so that said predetermined portion of the shadow generated by the shadow generating means coincides with the target point, wherein, said shadow generating means comprises a bar attached at a first end to at least one of a reflected signal pickup unit and pickup unit holder of the antenna and at a second end to a portion of a periphery of said reflector, and a plurality of projecting figure-shaped graduations formed on the bar;

said target indicating means comprising at least one line forming an angle with the shadow generating means and marked with graduations; and said target point specified by at least two coordinate values designating an intersection point at which a shadow of the bar of the shadow generating means intersects the line of the target indicating means.

15. The method according to claim 14, wherein the target point is determined on the basis of at least one type of a satellite, location information of the antenna, and time information of the antenna orienting the antenna.

16. The method according to claim 15, further comprising the steps of:

determining whether said antenna is positioned in an initial reference state in which a support post of the antenna is approximately positioned perpendicularly relative to an antenna installation site when viewed from a position facing the reflector, using a level mounted to a portion of the antenna; and adjusting said antenna to the initial reference state.

17. The method according to claim 16, further comprising the step of determining whether an obstacle is present in an antenna orienting direction using an obstacle observing means comprising a rod extended from a portion of a periphery of the reflector along the antenna orienting direction, and foresight and backsight which are spaced apart from each other and are formed on the rod.

18. An antenna comprising, an antenna assembly comprising:

a reflector for reflecting a signal;

a reflected signal pickup unit comprising a feed horn and a low noise block feeding a reflected signal;

a signal pickup unit supporting arm for positioning the reflected signal pickup unit at a specific position with regard to the reflector; and a pickup unit holder attached to an end of the signal pickup unit supporting arm for supporting the reflected signal pickup unit, means for supporting the antenna assembly, and an adjustable mounting mechanism for adjusting the antenna assembly in at least two directions, wherein said antenna further comprises:

a shadow generating means attached to the antenna so as for generating a shadow; and target indicating means provided on the reflector for specifying a target point on the reflector, on which a predetermined portion of the shadow generated by the shadow generating means is positioned when the antenna is oriented toward the transmitter, wherein, said shadow generating means comprises a bar attached at a first end to at least one of a reflected signal pickup unit and pickup unit holder of the antenna and at a second end to a portion of a periphery of said reflector, and a plurality of projecting figure-shaped graduations formed on the bar;

said target indicating means comprising at least one line forming an angle with the shadow generating means and marked with graduations; and said target point specified by at least two coordinate values designating an intersection point at which a shadow of the bar of the shadow generating means intersects the line of the target indicating means.

19. The antenna according to claim 18, further comprising a level mounted to said antenna to confirm whether a support post of the antenna is approximately perpendicularly to an antenna installation site when viewed from a position facing the reflector.

20. The antenna according to claim 19, further comprising an obstacle observing means which comprising a rod that is extended from a portion of a periphery of the reflector along an antenna orienting direction, and a foresight and a backsightjthat are spaced apart from each other and are formed on the rod.

* * * * *